US005870782A

United States Patent [19]

Kannenberg

[11] Patent Number: 5,870,782

[45] Date of Patent: Feb. 16, 1999

[54] FITNESS-BRUSH SHOWER INSTALLATION

[76] Inventor: Erich Kannenberg, Theodor-Heuss-Strasse 1, D-88677 Markdorf, Germany

[21] Appl. No.: 954,755

[22] Filed: Oct. 20, 1997

[30] Foreign Application Priority Data

Oct. 28, 1996 [DE] Germany ..... 196 44 706.2

[51] Int. Cl.[6] ..... A47K 3/22

[52] U.S. Cl. ..... 4/606; 4/605; 15/21.1

[58] Field of Search ..... 4/605, 606, 596; 15/21.1, 88.3, 88.4

[56] References Cited

U.S. PATENT DOCUMENTS

| | | | |
|---|---|---|---|
| 3,091,776 | 6/1963 | Roberts | 4/606 |
| 3,818,531 | 6/1974 | Saunders | 15/21.1 |
| 5,675,846 | 10/1997 | Kannenberg | 4/606 |

FOREIGN PATENT DOCUMENTS

| | | | |
|---|---|---|---|
| 2843683 | 10/1978 | Germany | 15/88.3 |

*Primary Examiner*—Henry N. Recla
*Assistant Examiner*—Kerry S. Culpepper
*Attorney, Agent, or Firm*—Browdy and Neimark

[57] ABSTRACT

A fitness-brush shower installation has a head rod (5) including a drive head (6). The head rod is pivotable in a horizontal plane and can be secured at a selected position. A vertical, rotatable brush roller (7) is interchangeably suspended on a drive head (6) under the head rod. A gear (21) is coupled to at least one drive (23, 32) comprising conical gear-wheel shafts (20) which set the brush roller (7) in rotation. The gear (21) is coupled to a brush-roller driver. The brush roller (7) telescopically extendable in the vertical direction. Its extension is a function of water flowing into a hollow brush core (8) of the brush roller, resisted by a restoring spring (45).

24 Claims, 3 Drawing Sheets

23
21
32

25
33
35
26
34
5
20
6
8
25
4
3
27
1
9
36
7
2

17
9
16

9
15

9
13
14
8
44
41
40
39
38
37
43
42
18

11
45
7
12
19

FITNESS-BRUSH SHOWER INSTALLATION

FIELD OF THE INVENTION

The invention relates to a fitness-brush shower (or, brush massage) installation for comprehensive personal hygiene in a bathroom, a medical facility, or some other location.

REVIEW OF THE RELATED TECHNOLOGY

German Patent Application 19 510 805, corresponding to U.S. Pat. No. 5,675,846, discloses a fitness-brush shower installation whose drive combination includes three gearings, with the center main gear being driven by rotating shafts connected on both sides; connected to the ends of the rotating shafts are a water turbine gear and an electrically-driven intermediate gear, which obtains its rotational forces from a drive shaft that is guided through the wall and connected to an electric motor on the outside of the wall.

OBJECTS AND SUMMARY OF THE INVENTION

The present invention has an object, among others, to overcome deficiencies in the prior art.

It is an object of the invention to create a device designed to save superfluous rotating shafts and gearing, so that a gear block delivers the same performance as that of the prior art but with fewer assemblies that are susceptible to wear, and has a lower consumption of rotational energy, the device driving a brush roller whose improvements make it advantageous to use.

The fitness-brush shower installation of the present invention has a rail that is fixed to a wall and has a head rod that is reinforced to resist bearing force and can pivot and be secured, with a drive head being installed beneath the head rod. Latched in the drive head is a vertically freely-hanging, interchangeable brush roller that is set into operation by a main gear that obtains its rotational forces from a laterally-connected pressure-medium motor, or from an electric motor connected to another side.

The invention assists people in maintaining their health by promoting circulation, and can be used without causing problems. A total-body massage with variably-selectable brushes is available. As a special comfort feature, the installation offers both wet and dry massage.

BRIEF DESCRIPTION OF THE DRAWING

The above and other objects and the nature and advantages of the present invention will become more apparent from the following detailed description of an embodiments taken in conjunction with drawings, wherein.

DETAILED DESCRIPTION OF THE PREFERRED EMBODIMENT

Figure 1:
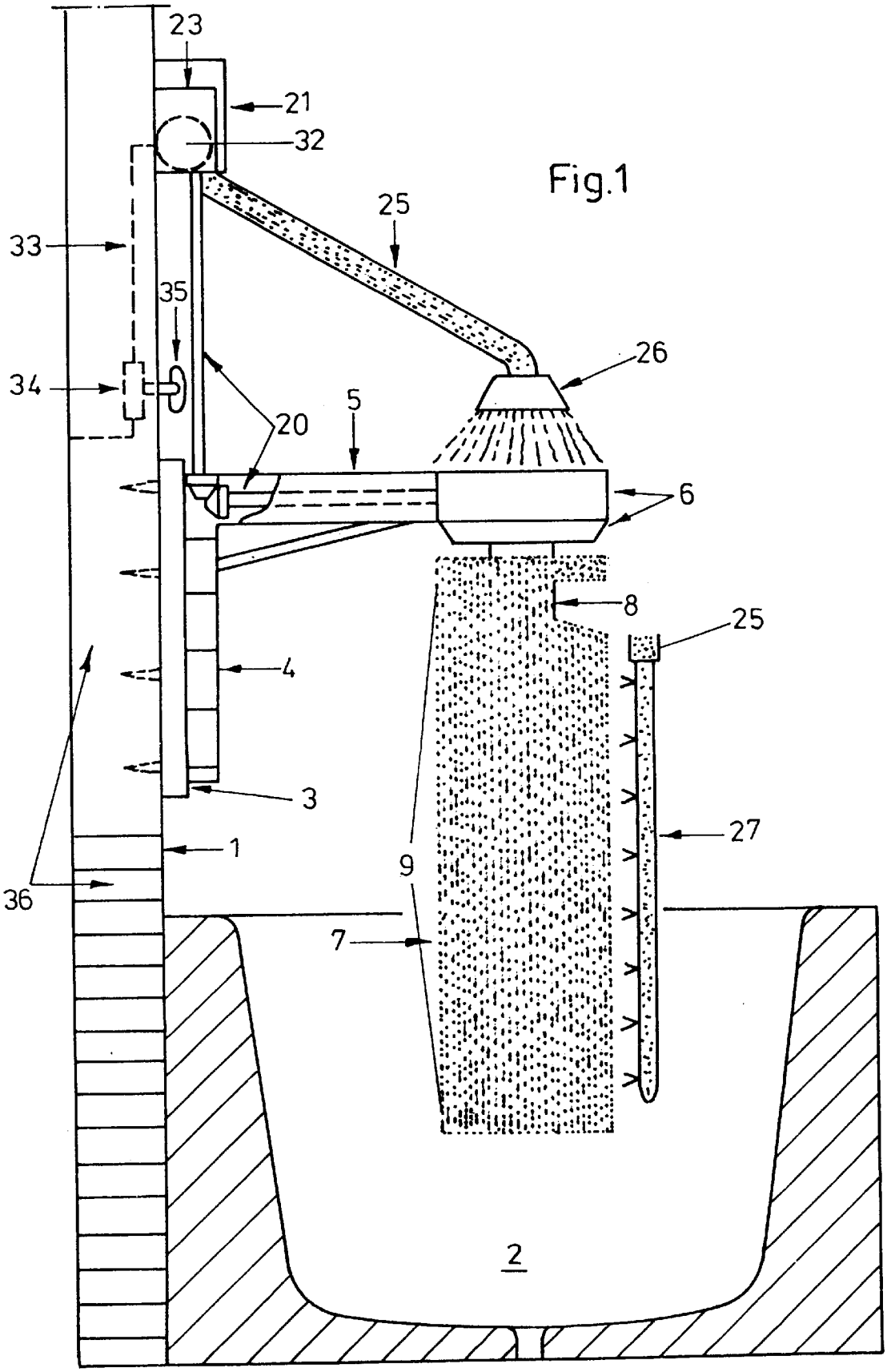
FIG. 1 is a partially schematic side view of the invention.

FIG. 1 and the other figures show some major features of the fitness-brush shower installation of the invention: a main gear 21 that drives a brush; a laterally-connected electric motor 32; a pressure-medium motor 23 that is connected to another side; and a head rod 5 (or, support arm) that can pivot and be secured against pivoting. The head rod 5 has a drive head 6 that supports the brush roller 7.

The dimensions of a fitness-brush shower installation can be individually tailored so that standardized sizes can be used for both adults and children.

A vertically-secured wall rail or rail 3, to which a pivotable head rod 5 can be secured, is located on the fixed inside of the wall 1 of a bathroom, above the upper rim of a bathtub 2. Besides with a bathtub, the invention can be used above the upper rim of a stand-up tub of a shower stall, or on a traveling or stationary base, or in a base that can be folded up and transported. The pivotable head rod 5 is attached to the wall rail or rail by a vertical-axis, vibration-free hinge 4, and includes means to be secured in one position.

A drive head 6 is installed beneath the head rod 5, and supports a brush roller 7 that is fixedly latched and is vertically freely-hanging, and whose entire brush core 8 is equipped with permanently-attached bristles 9 or interchangeable bristles 10.

A conical gear-wheel shaft 20, which is seated in the U profile of the head rod 5 so as to be protected against accidents and is connected to the drive head 6, leads to a main gear 21 that has a protected plug connection 22 and a switchable idling operation, as well as a switchable counterclockwise rotation and clockwise rotation each with adjustable rpm variable continuously.

Figure 2:
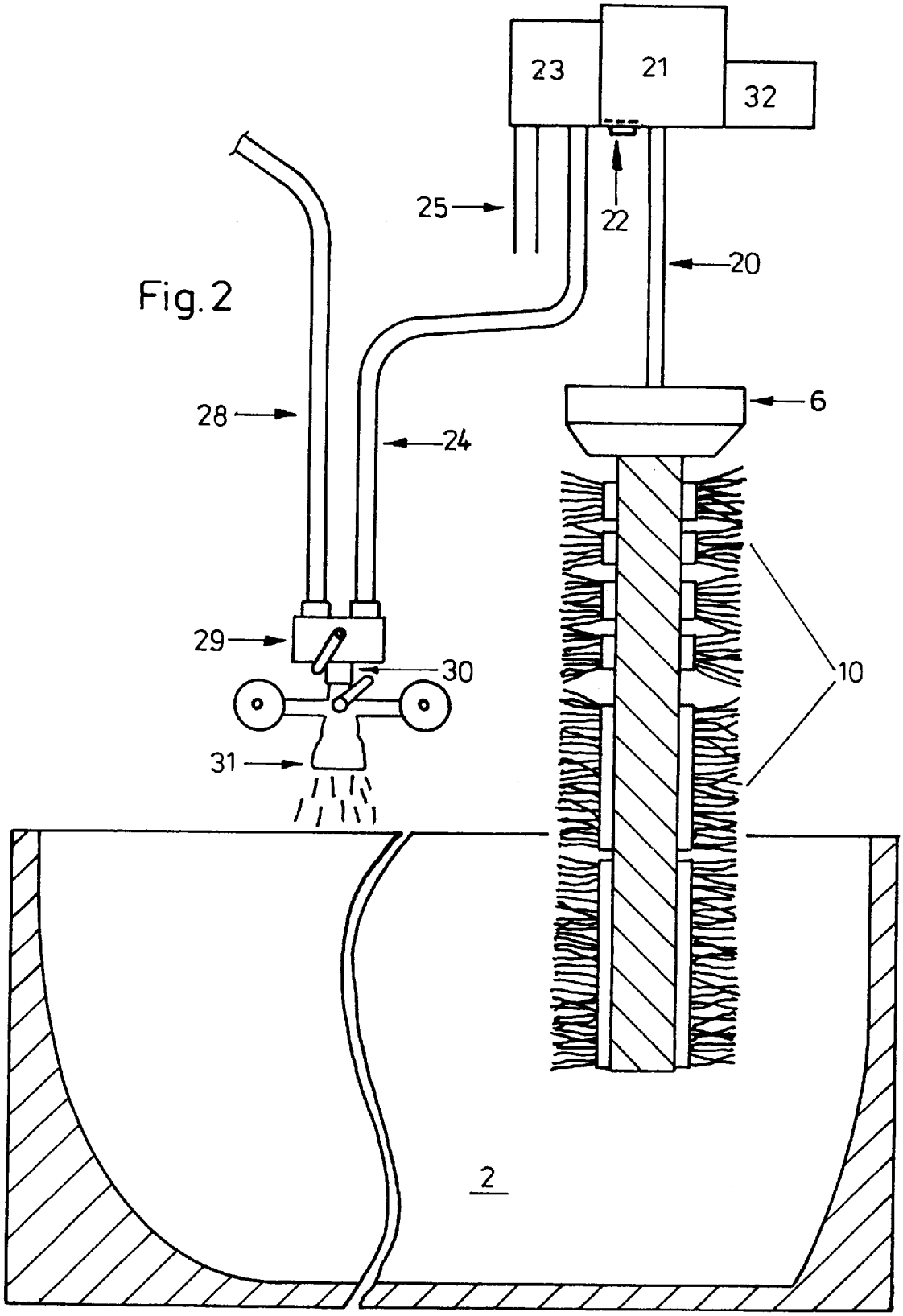
FIG. 2 is a partially schematic elevational or frontal view of the invention shown in FIG. 1.

FIG. 2 shows how a main gear 21 obtains its rotational force from a laterally-connected fluid (pressure-medium) motor 23, which is driven by variable quantities of water that flow through under pressure and are introduced in a controlled manner, with the quantities of water that have flowed through being carried off without pressure into a connected hose 25, at the lower end of which a shower head 26 or shower column 27 (both shown in FIG. 1) is connected, which wets the rotating brush roller 7 with the sprayed water from above or from the side.

FIG. 2 shows the water-introducing connecting segments of the water-supply line 24 and the flexible hand-shower water line 28 are screwed by their adjacent union nuts to a mechanically-reversible mixed-water, two-way connection 29 whose water-inlet connection piece 30, located underneath it, is secured by its union nut to the combined cold/warm-water inlet armature 31.

A retrofittable electric motor 32 complying with the safety requirements of DIN P33 is connected to the other side of the main gear 21 (FIG. 2). Its connected, protected electric cable 33 leads to a potentiometer 34 that is set, with electrical protection, into the inside of the wall 1 as an intermediate circuit. A mechanical rotary switch 35 connected to the potentiometer switches the continuously-rotating command variables, which are conducted further, as a desired current intensity for the desired magnitude of rotation, by the potentiometer 34 to the electric motor 32.

Figures 3A, 3B, 3C, 3D:
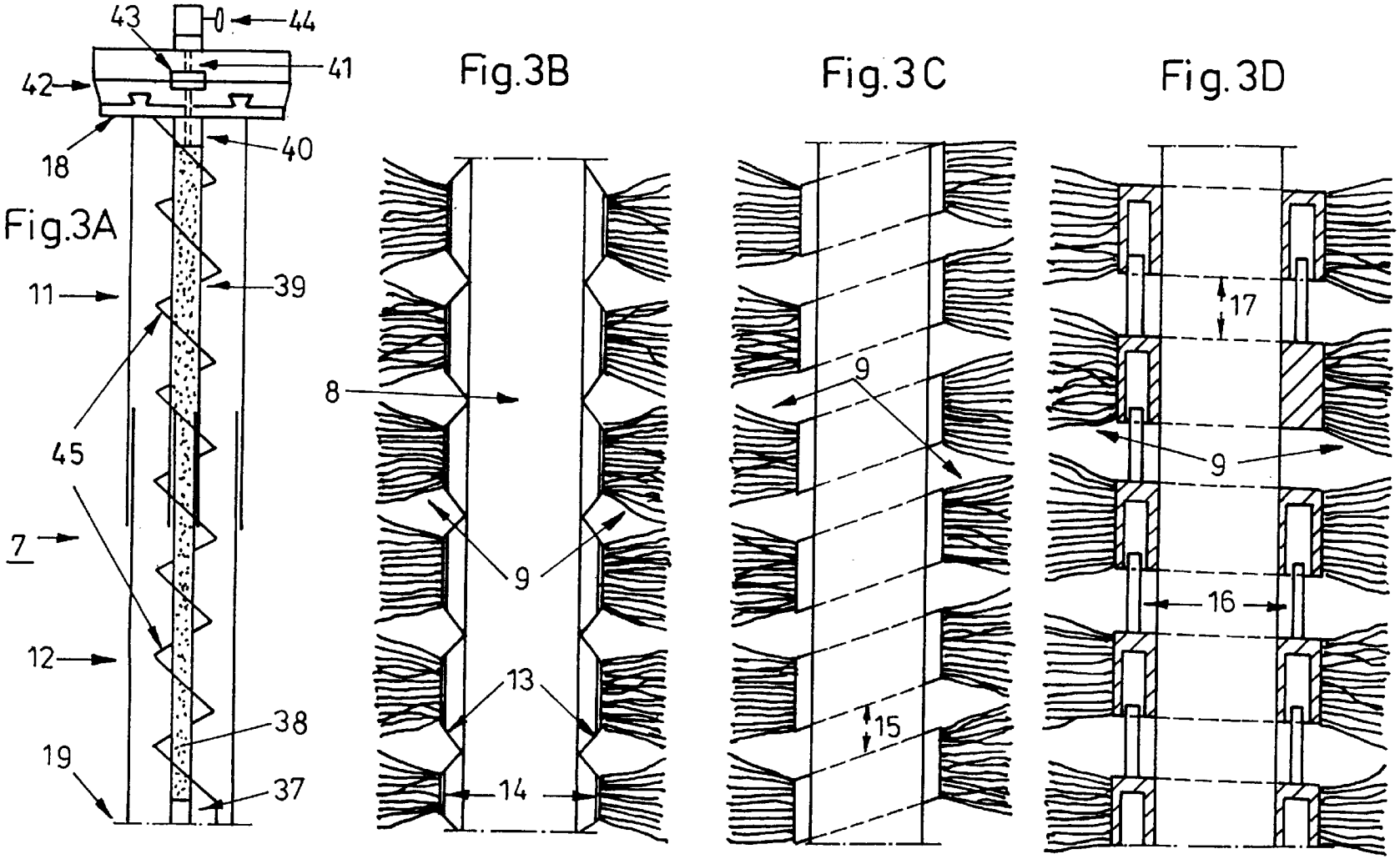
FIGS. 3A–3D shows the brush roller in various views.

FIG. 3A shows the telescope-like brush roller 7, which can extend and retract and comprises: an inside cylinder 12, 39 that is divided in two and forms the brush core; and an outside cylinder 11, which is likewise divided in two. At the top, the two cylinders 11, 12 are secured beneath the head plate 18. They are secured at the bottom to a base plate 19. A restoring spring 45, that holds the divided telescopic cylinders 11 and 12 together, and that retracts after an extension, is disposed to be secured at the top to the head plate 18; at the bottom, it is secured to the base plate 19.

The base plate 19 extends with a plunger 37 into the lower end of the inside cylinder 12. A water column 38 in the water-pressure cylinder 38 acts on this plunger 37, causing the brush roller 7 to extend to a greater or lesser degree, in telescope fashion, depending on the water pressure. The head plate 18 is removably held to a screen connection plate 42 of the drive head 6. The two plates 18, 42 have a water connection coupling 43 and a bore opening 41 that leads into the inside cylinder 12, through which water travels into the brush core 12. A water faucet 44 for supplying and blocking water and setting the water pressure is provided on the screen plate 42.

In alternative embodiment, the brush roller 7 can also be displaced in telescopic fashion by hand, without water pressure, and stopped in any lengthwise position by screwing means, plug means or latching means.

What is claimed is:

1. A fitness-brush shower installation, comprising:

a head rod (5) including a drive head (6), the head rod being pivotable in a horizontal plane and securable at a position therein;

a vertical, rotatable brush roller (7) that is interchangeably suspended on the drive head (6);

a gear (21) coupled to at least one drive (23, 32) comprising conical gear-wheel shafts (20) to set the brush roller (7) in rotation;

the gear (21) being coupled to means for selectively driving the brush roller (7);

the brush roller (7) being extendable and retractable in telescope fashion in a vertical direction, extension thereof being a function of water flowing into a hollow brush core (8) of the brush roller and of a restoring spring (45).

2. The fitness-brush shower installation according to claim 1, wherein the means for selectively driving includes at least one of (a) a water-actuated pressure-medium motor (23), (b) to an electric motor (32), and (c) provided with a water-actuated pressure-medium motor (23) and an electric motor (32).

3. The fitness-brush shower installation according to claim 1, wherein:

the installation further comprises a securable wall rail (3), to which the head rod (5) is attached;

the head rod (5) is reinforced with respect to a bearing force and includes a protective U profile;

a conical, force-transmitting shaft (20) that runs on bearings is imbedded in the protective U profile;

the shaft is connected to the drive head and the drive head supports the brush roller;

the brush roller is rotatable, dividable, and interchangeable, includes an outside cylinder and an inside cylinder (11, 12), is extendable by water pressure, and is pivotably guidable into a wall niche after use;

the installation further comprising a main gear (21) coupled at one side to a laterally-connected electric motor (32) that runs clockwise, and, at another side, to a pressure-medium motor (23) that runs counterclockwise, a water-supply line (24) and a hose (25) that carries off water being connected to the pressure-medium motor, the hose supporting at each end thereof a connected shower head (26) or shower column (27);

the installation further comprising water-conducting connection pieces of the water-supply line (24) and a hand-held shower water line (28), which are screwed together adjacent a mixed-water two-way connection (29), including a water-inlet connection piece (30) located underneath is screwed to the cold/warm-water armature (31);

the installation further comprising a potentiometer (34) set into an inside of the wall (1) and connected to a protected electric cable (33), the potentiometer conducts current intensities which are switched to be continuous, as a desired magnitude of rotation from its connected rotary switch (35) to the electric motor (32);

whereby, during desired body cleaning with simultaneous wet, total-body massage, the fitness-brush shower installation is to be operated in the a sequence wherein the mixed-water two-way connection (29) is to be set by a prior reversal from the hand-held shower water line (28) to the water-supply line (24), pre-tempered water flowing out of a cold/warm-water inlet armature (31) is reversed and thereby conducted into the mixed-water two-way connection (29), which allows introduced water current to flow into the predetermined water-supply line (24), the water flowing under pressure into the pressure-medium motor (23) is introduced into the motor and sets it in motion, the initiated rotational force of the pressure-medium motor (23) is transmitted to the connected main gear (21), and the water flowing away without pressure in the hose (25) is conducted into a water-spraying shower head (26) or into a water-spraying shower column (27), a centrally-disposed plunger (37) is attached to an inside floor of a base plate (19) at an end of the cylinder, with a long, test tube-like water-pressure cylinder (38) that is left open at a top thereof being tightly positioned on the plunger and surrounded by an overhanging cylinder (39) placed on it from above and sliding slightly, the cylinder being secured to a tightly-positioned connecting plunger (40) beneath the head plate (18) at the end of the cylinder, the connecting plunger (40) including a bore opening (41) that lets in water and is guided through the head plate (18) and the screen connection plate (42) connected in a curved manner, the opening ending in a fixedly-connected, rotatable, water-conducting water-connection coupling (43) that guides a water-introducing bore opening (41) thereof upwardly through the drive head (6), at an upper bore-hole end of which a water-conducting water faucet (44) is attached that introduces the open water into the overhanging cylinder (39) under pressure, such that the water-pressure cylinder (37) is guided out vertically downwardly with a vertically-connected restoring spring (45), thus lengthening the expandable body of the brush roller (7), the working main gear (21) is switched from idling operation, continuously and selectively, into a clockwise or counterclockwise work cycle, while a connected conical gear-wheel shaft (20) further conducts the rotational force being established to the drive head (6), which sets the brush roller (7) into a rotational work cycle, only the electric motor (32) is switched on dry massage, the motor being connected via the connected electric cable (33) thereof to a potentiometer (34), the potentiometer (34) is switched by a continuous rotary switch (35) that further conducts the switched current intensity for a desired magnitude of rotation to the electric motor (32), the entire brush core (8) of the brush roller (7) is equipped with permanently-attached bristles (9) or interchangeable bristles (10), the extendable brush core (8) of the brush roller (7) is formed by a thin-walled outside cylinder (11) that supports an extendable and retractable inside cylinder (12), which lengthens the body of the brush roller (7) in the manner of a telescope, the outside cylinder (11) is surrounded by a bellows (13) that expands in accordion fashion and is equipped with permanently-attached bristles (9) on vertically-outside, uniformly-extendable rear sides (14) thereof, the outside cylinder (11) is surrounded by a plastic-like, easily-expanding feed spiral (15), an outside of which is twisted in spiral shape and is equipped with permanently-attached bristles (9), the outside cylinder (11) is surrounded by vertically-stacked, segment-like rings (17) of equal width that are equipped with retractable spacers (16) spring-loaded all around, outside roundings of the rings (17) are equipped with permanently-attached bristles, the ends of the bodies of the bristle-equipped elements (13 or 15 or 17) are respectively secured beneath the head plate (18) of the outside cylinder (11), which head plate is at the end of the cylinder, and on the base plate (19) of the inside cylinder (12), which base plate is at the other end of the cylinder, such that the inside cylinder (12), being drawn out vertically downwardly, lengthens the expandable, extendable, bristle-equipped body of a brush roller (7);

the brush drive of a fitness-brush shower installation includes a pressure-medium motor (23) and the main gear (21), the brush drive includes the electric motor (32) and the main gear (21), or the brush drive comprises a combination of the main gear (21) and the laterally-connected pressure-medium motor (23) and an electric motor (32) connected to the another side thereof.

4. The fitness-brush shower installation according to claim 1, wherein the roller brush (7) is driven by a pressure-medium motor (23).

5. The fitness-brush shower installation according to claim 1, wherein the main gear (21) is driven by an electric motor (32) that is protected in accordance with DIN, the main gear (21) is driven by the electric motor (32), the electric motor is secured to an outside of a wall and includes a drive shaft leading through the wall, where it is connected on a rear side to the main gear (21) on an inside of the wall (1).

6. The fitness-brush shower installation according to claim 1, wherein the gearing and the gear housing of the pressure-medium motor (23) and the main gear (21) comprise at least one of metal and plastic.

7. The fitness-brush shower installation according to claim 5, wherein the main gear (21) includes a protected plug connector (22).

8. The fitness-brush shower installation according to claim 3, wherein the front side of the main gear (21) includes a viewing window that displays mechanically or electrically mechanically-rotated rpm of a rotating brush roller (7).

9. The fitness-brush shower installation according to claim 1, wherein a hinge (4), the head rod (5), the drive head (6) and the conical gear-wheel shaft (20) comprise at least one of metal and plastic.

10. The fitness-brush shower installation according to claim 1, wherein a horizontally-secured drive gear is attached to a reinforced drive of a fitness-brush shower installation and is coupled mechanically or electromagnetically thereto, on one or both sides of the gear, and a plurality of the brush roller (7) are suspended vertically on the underside with equal spacing and are of equal length, being connected to a plurality of the drive shaft and being set into rotation individually.

11. The fitness-brush shower installation according to claim 1, wherein an entire brush core (8) of the brush roller (7) comprises at least one of wood, plastic, and metal.

12. The fitness-brush shower installation according to claim 1, wherein bristles (9) are permanently attached to an entire brush core (8).

13. The fitness-brush shower installation according to claim 12, wherein the entire brush core (8) is equipped with permanent, synthetic bristles that are artificially, monochromatically colored; artificially colored with graduated, multiple colors; or are artificially colored with a mixture of multiple, iridescent colors.

14. The fitness-brush shower installation according to claim 1, wherein an entire brush core (8) is equipped with interchangeable bristles (10) attachable to the brush core (8) in a selection of fixedly-bundled, round paintbrush shapes, or fixedly-bundled, rectangular, pencillate shapes or long, comb-like shapes securable to a rear side of the brush core (8) having no bristles through a screw, stopper or latching connection.

15. The fitness-brush shower installation according to claim 14, wherein the interchangeable bristles (10) secured to the entire brush core (8) include synthetic bristle material and are colored monochromatically or with a mixture of multiple colors and iridescent colors.

16. The fitness-brush shower installation according to claim 1, wherein the brush roller includes an outside cylinder (11) and a removable inside cylinder (12) formed from a thin-walled wood or metal or a thin-walled plastic.

17. The fitness-brush shower installation according to claim 1, comprises a bellows (13) surrounding an outside cylinder (11) in accordion fashion, the bellows being secured on both sides thereof to vertically-extending, bristle-equipped rear sides (14).

18. The fitness-brush shower installation according to claim 1, wherein a twisted, bristle-equipped feed spiral (15) surrounds an outside cylinder (11).

19. The fitness-brush shower installation according to claim 1, wherein bristle-equipped rings (17) surround an outside cylinder in segment fashion and are embodied with uniform spacers (16), and the rings (17) have a uniform ring width and ring thickness and are produced from at least one of wood, plastic, and metal.

20. The fitness-brush shower installation according to claim 1, wherein a length of a body of a brush core (8) is equipped with permanent bristles (9) and can be divided into partial pieces which can be screwed to another piece, each including an opening at a body end, the opening having an inside thread, and the body end being attachable by a screw connection having a pin that supports a thread that fits and is screwed into the opening.

21. The fitness-brush shower installation according to claim 1, wherein the head rod is pivotable and the freely-hanging brush roller (7) is pivoted by means of the pivotable head rod (5) into a special half-round, tiled wall niche.

22. The fitness-brush shower installation according to claim 1, including a faucet (44) and wherein, after the faucet has been closed, water that has backed up under pressure is carried off through a sliding, movable, round connecting seam between a water-pressure cylinder (37) and an overhanging cylinder, and an expanded restoring spring (45) secured to a base plate (19) and disposed beneath a head plate (18), retracts a lengthened body of the brush roller (7).

23. The fitness-brush shower installation according to claim 22, wherein the water-pressure cylinder (37) and the overhanging cylinder (39) comprise at least one of plastic and metal.

24. The fitness-brush shower installation according to claim 1, wherein the brush roller (7) is manually changeable in length in telescope fashion without water pressure and stoppable at a predetermined length.

* * * * *